US005945625A

United States Patent [19]

Zielinski

[11] Patent Number: 5,945,625

[45] Date of Patent: Aug. 31, 1999

[54] TANK TURRET

[75] Inventor: Erich Zielinski, Düsseldorf, Germany

[73] Assignee: Rheinmetall W & M GmbH, Unterlüss, Germany

[21] Appl. No.: 08/123,902

[22] Filed: Mar. 1, 1993

[30] Foreign Application Priority Data

Feb. 28, 1992 [DE] Germany ..... 42 06 218

[51] Int. Cl.[6] ..... F41A 23/24

[52] U.S. Cl. ..... 89/36.13; 89/37.12

[58] Field of Search ..... 89/36.13, 37.01, 89/37.07, 37.12, 37.15, 42.01

[56] References Cited

U.S. PATENT DOCUMENTS 5,105,715 4/1992 Nordmann et al. ..... 89/36.13

*Primary Examiner*—Charles T. Jordan
*Attorney, Agent, or Firm*—Venable; Norman N. Kunitz

[57] ABSTRACT

A tank turret comprising a turret housing (2), a moveable solid front armor (3) and a weapons system including a gun barrel (4) that can be pivoted and displaced in the longitudinal direction of the gun barrel, with the front armor (3) being mounted for rearward horizontal movement and connected with the gun barrel (4) in order to increase the recoiling mass, and with a damping element (11) being disposed between the front armor (3) and the turret housing (2). In order for the vertical energy component that occurs when the weapon is elevated to be substantially compensated without any reactive influence on the weapon, a recoil brake (7,7') is provided as the connection between the gun barrel (4) and the front armor (3) and the trunnions (6) of the gun barrel cradle tube (5) are mounted within the turret housing (2).

9 Claims, 3 Drawing Sheets

TANK TURRET

BACKGROUND OF THE INVENTION

The present invention relates to a tank turret of the type including an armored turret housing having a moveable solid front armor, a gun barrel mounted in a cradle tube within the tank turret so as to be pivotal and displaceable in the longitudinal direction of the gun barrel during recoil, with the front armor being coupled with the gun barrel in order to increase the recoiling mass, and a damping element disposed between the front armor and the turret housing.

A tank turret of the above type is disclosed in German unexamined published patent application No. DE 3,930,256.A1, corresponding to U.S. Pat. No. 5,105,715. These references propose to reduce the recoil of the weapon in that functional masses existing in the tank turret, such as the forward armor, are included in the recoiling mass. With this measure, it becomes possible to either substantially shorten the recoil paths of the weapon when conventional ammunition is used or to employ higher powered ammunition with the same recoil paths. In addition, such tank turrets have a special protection against external influences. Projectiles penetrating the front armor, where their kinetic energy is consumed, produce less of a shock to the interior housing of the turret than, for example, the firing of a round. The reactive influence of active protective elements is also minimized.

The primary drawback of these prior art tank turrets is that the recoil energy is absorbed only by a horizontally displaceable mass or an approximately horizontally displaceable mass, even if the weapon is elevated, so that the vertical component of the recoil energy is not consumed and very high forces are introduced into the turret bearing. As a result of high mass accelerations, this may result in damaging influences on the aimed weapon and thus on the hit accuracy.

It is therefore an object of the present invention to further develop a tank turret of the above-mentioned type in such a way that the vertical energy component occurring when the weapon is elevated has practically no reactive effect on the weapon, at least until the projectile leaves the muzzle.

SUMMARY OF THE INVENTION

The above object generally is achieved according to the present invention by a tank turret which comprises: an armored turret housing having a race ring for mounting the housing on a support for rotation and a separate solid front armor at a front side of the housing; a gun cradle tube having trunnions disposed and mounted within said turret housing for pivotal movement about the trunnions; a gun barrel mounted in the cradle tube to be pivotal with the cradle tube and displaceable in a longitudinal direction of the gun barrel; means for supporting the solid front armor for movement in the longitudinal horizontal direction of the gun barrel; a damping element disposed between the front armor and the turret housing; and means for connecting the solid front armor with the gun barrel for movement thereof in the longitudinal horizontal direction in order to increase the recoiling mass, with the means for connecting including at least one recoil braking device connected between the gun barrel and the solid front armor.

Preferably, the recoil braking device is composed of two recoil brakes disposed respectively on opposite sides of the gun barrel, with each of the recoil brakes having a brake cylinder fastened to the breech ring of the gun barrel and a brake piston rod connected to the solid front armor at a front end thereof. Moreover, according to the preferred embodiment of the invention, each of the brake piston rods is connected to the front armor via a hood to which each of the piston rods is fastened, with the hood being disposed on the gun barrel in front of the solid front armor for pivotal movement with the gun barrel, and with the hood being supported on the front armor by correspondingly shaped circular faces on the hood and on the front armor.

According to further features of the invention the damping element and/or the support means for the solid front armor may be a respective rubber plate. However, preferably, the means for supporting solid front armor includes a pivot beam mounted on the turret housing race ring and extending transverse to the longitudinal direction of the gun barrel, and a correspondingly shaped recess formed in a bottom surface of the solid front armor and into the pivot beam extends, with the recess being elongated in the longitudinal direction and being positioned in the longitudinal direction to permit the solid front armor to slide toward the rear in approximately the horizontal direction with a pitching movement about the axis of the pivot beam.

Finally, according to still a further feature of the invention, an elastic radial support bearing is inserted in the hood to permit the hood to perform a transverse movement relative to the cradle tube.

The invention is thus essentially based on the concept of not connecting the weapon rigidly with the recoiling front armor, as disclosed in the above-mentioned prior art references, but to provide the connection by way of the piston rods of a recoil braking device. Thus, the majority of the vertical forces are absorbed by the recoil brake of the gun barrel and act on the fixed turret housing only in a reduced fashion. Frequently a rubber damper or shock absorber is sufficient as a damping element between the front armor and the turret housing.

In order to consume the remaining vertical force component, the front armor may also be supported by way of a rubber plate on the race ring of the turret housing. However, it has been found to be particularly advantageous to support the front armor by way of two pivot beams or beam supports provided on the race ring, with a recess being disposed in the lower surface of the front armor to permit an approximately horizontal sliding movement of the front armor toward the rear along the beams as well as a pitching movement about the axis of the pivot beams.

Further details and advantages of the invention will become evident from the embodiments described in detail below with reference to the drawing figures.

DETAILED DESCRIPTION OF THE PREFERRED EMBODIMENTS

Figure 1:
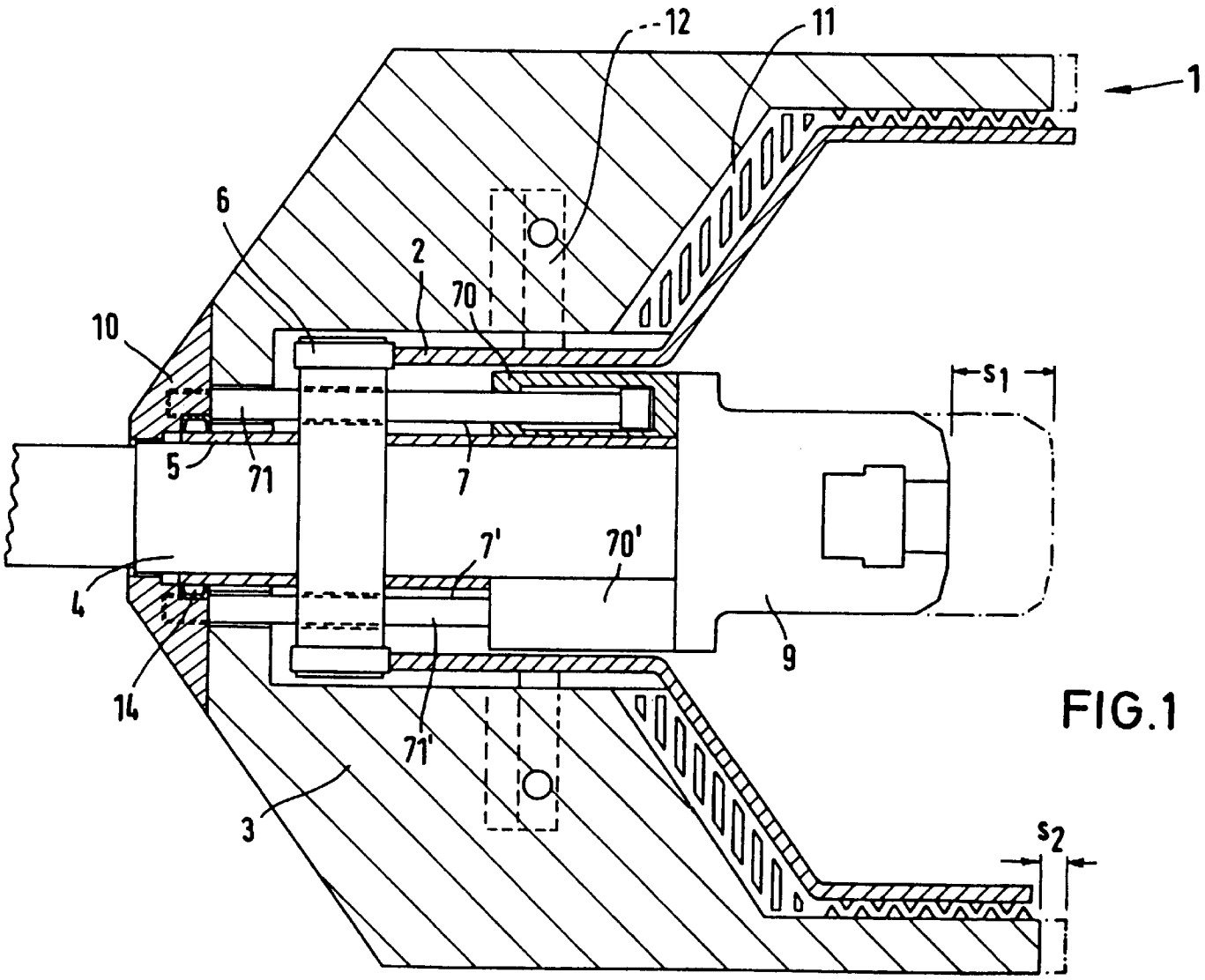
FIG. 1 is a schematic top view, partially in section, of the front portion of a tank turret according to the invention.

Referring to FIG. 1, there is shown the forward portion of a tank turret 1 essentially composed of a turret housing 2, a solid front armor 3 and a weapons system that is not identified in detail. The weapons system includes a gun barrel 4 and a cradle tube 5 in which the gun barrel 4 is mounted for recoil movement in the direction of the longitudinal axis of the gun barrel. The cradle tube 5 is in turn mounted for pivotal movement (elevation) about its trunnions 6 which are mounted in the interior of the fixed turret housing 2. The turret housing 2, in a known manner, is mounted for rotation about its longitudinal (vertical) axis, a race ring (not shown in FIG. 1) which is supported in a horizontal position on the supporting structure or tank body. The solid front armor 3 is mounted in the turret 2 so that it is moveable rearwardly in a horizontal direction during recoil of the gun in a manner to be describe in more detail below.

According to the invention, recoil brakes 7 and 7' are disposed between the moveable front armor 3 and gun barrel 4. The brake cylinders 70 and 70' of recoil brakes 7 and 7' are fastened to the breech ring 9 of the gun barrel 4 and are disposed laterally on opposite sides of the gun barrel 4. During recoil of gun barrel 4, the piston rods 71 and 71', of recoil brakes 7 and 7' are supported in a hood shaped plate or hood 10. Hood 10 is mounted on the cradle tube 5 of the weapon system and is configured in such a way that it has a circular rearwardly facing surface 15 (FIG. 2) which, during recoil of the gun barrel 4, is able to rest on the front armor 3 whose forward region is configured correspondingly.

Between front armor 3 and the fixed turret housing 2, there is a shock absorbing layer or damping element 11, for example, a rubber plate. For example, in a high powered cannon encountering a gas force pulse of 50,000 Ns, the gun barrel recoil could be reduced to less than 25 cm, with the front armor 3 being moved back only in an order of magnitude of 5 cm so that a rubber plate of such a wall thickness would be sufficient.

For the case where armored cannons are employed that encounter a very high recoil force and thus the longer recoil path for the front armor precludes the use of rubber plates, such plates could be-replaced by hydraulic brake cylinders, in which case the longitudinal guide for the front armor 3 can advantageously be attached centrally in the horizontal plane to the gun tunnel of the turret housing 2.

Figure 2:
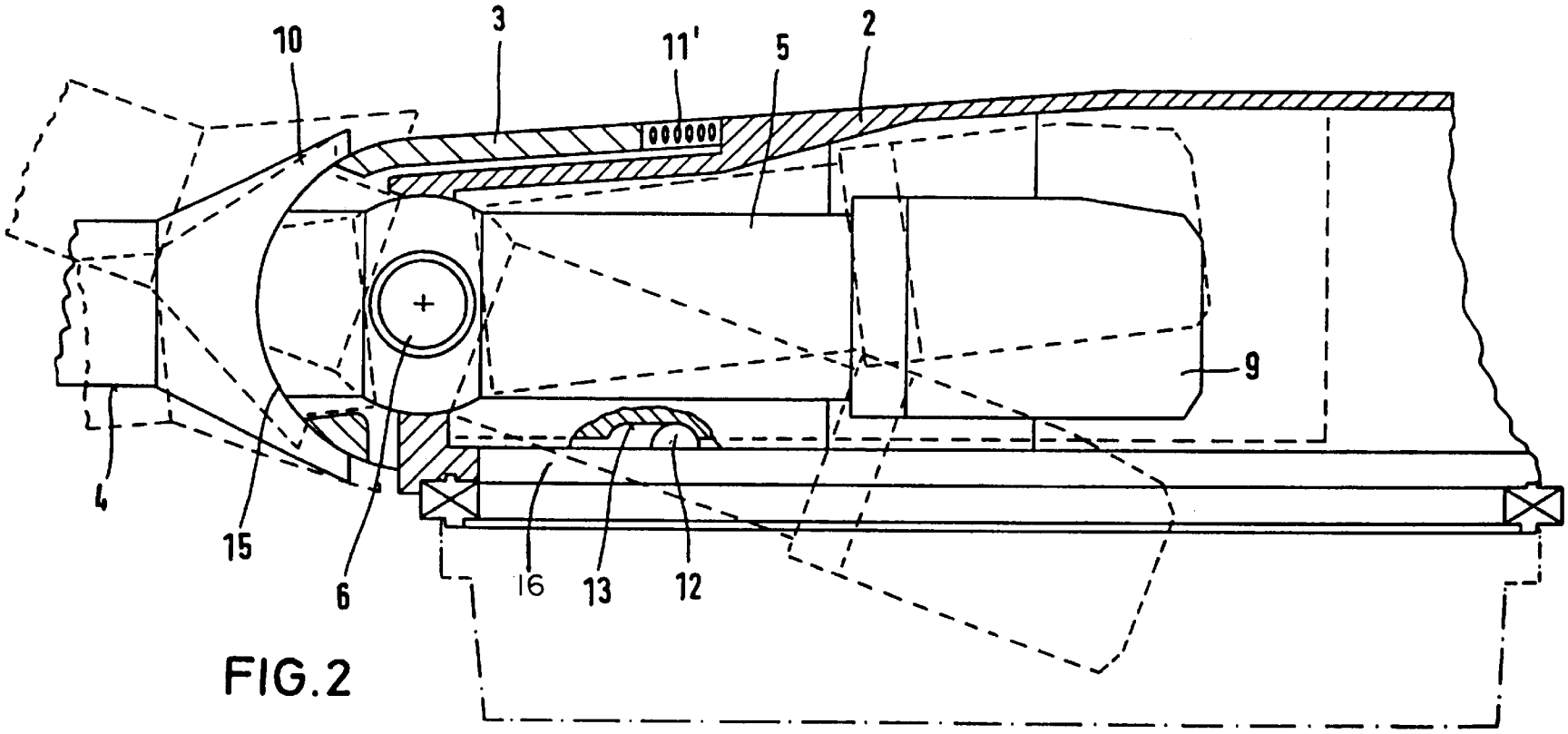
FIGS. 2 and 3 are schematic side views, partially in section, of the tank turret according to FIG. 1 in the forward and recoiled positions of the gun barrel, respectively.
Figure 3:
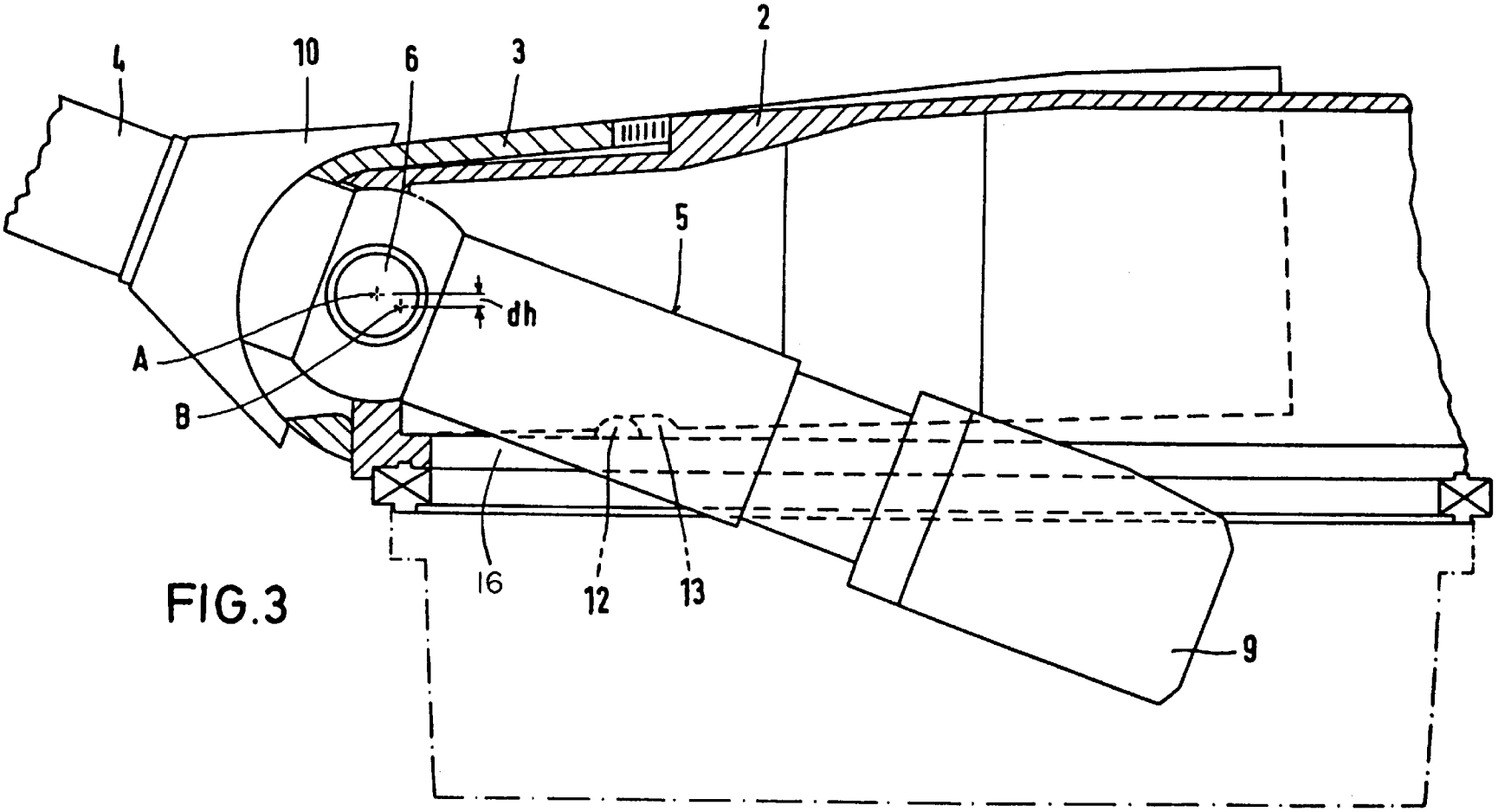

By using a rubber plate (not shown), the weight of front armor 3 may also be supported on the race ring 16 (see FIG. 2) of turret housing 2. However, at least one pivot beam 12 extending transverse to the longitudinal axis of the gun barrel 4 and mounted on the race ring 16 may also be employed for the support of the armor 3. Preferably as shown, two aligned pivot beams 12, one on each side of the gun barrel are provided. As shown in FIGS. 2 and 3, the lower or bottom surface of the front armor 3 is provided with a recess 13 which is correspondingly shaped to the pivot beam 12, which extends in the longitudinal direction of the gun barrel 4 and which is disposed at that location which permits front armor 3 to slide approximately horizontally backward. Moreover, the upper surface of the beam support 12 is shaped so that the front armor 3 is able to perform a pitching movement about the axis of beam support 12. This becomes necessary if, with gun barrel 4 in the elevated position, front armor 3 is forced to escape in the vertical direction.

The hard support of front armor 3 on the beam or beams 12 additionally prevents the mass of the armored protection from vibrating during travel of the tank. The pitching movement is then damped either by a rubber plate 11 or by pre-tensioned spring elements 11' disposed between the armor 3 and the housing 2.

Front armor 3 is preferably given such a configuration that it can be pushed onto the inner turret housing from the top, with gun barrel 4 installed, and can then be retained from the interior of the turret by means of anchor screws. The anchor screws and the weight of front armor 3 acting over a sloped surface may produce tension in rubber plates 11. The characteristic of the spring support of front armor 3 and its counter-recoil behavior can be supported by means of hydraulic shock absorbers, which are not shown here, that have a particularly short stroke.

The operation of the invention will now be described in greater detail.

If a round is fired from the horizontal position (FIG. 2, solidly drawn gun barrel 4), gun barrel 4 slides horizontally backward during firing over a path s1 (FIG. 1) and, by way of breech ring 9 to which recoil brakes 7 and 7' are fastened, moves the latter backward. The thus generated hydraulic braking force is transferred by way of piston rods 71 and 71' to the hood 10. The hood 10 is supported by its circular surface 15 on the front armor 3 and thus moves the latter against the resistance of rubber plates 11 over a path s2 toward the rear, sliding over the beam support 12. During this process, the hood 10 slides over cradle tube 5 without transferring any transverse forces or bending moments.

Conditions are more problematic with gun barrel 4 elevated. This is shown in FIG. 3 in which gun barrel 4 is shown in the recoiled position. During this movement, the pivot axis of hood 10 is moved from position A to position B. The thus created difference in height dh is the amount by which the front armor 3 must be moved downward at this location in addition to its horizontal recoil movement. This is accomplished by a corresponding pitching movement of the front armor 3 about the axis of the beam support 12.

However, the pitching movement of front armor 3 exerts a torque stress by way of hood 10 on cradle tube 5 about trunnion 6. To suppress this influence until the projectile has left the muzzle, an elastic radial bearing 14 (FIG. 1) is preferably inserted between cradle tube 5 and the hood 10 so as to permit slight transverse movements of hood 10 relative to cradle tube 5. By suitably adjusting the recoil device, the transverse movement of the hood 10 caused by the recoil movement of the front armor 3 should be dimensioned so small that it is substantially less than 1 mm until the projectile leaves the muzzle. Only after the projectile has left gun barrel 4 should the influence of the transverse movement of the front armor 3 on cradle tube 5 be so large that the elastic radial bearing 14 is no longer able to compensate for this influence and thus a torque is forced onto the elevation adjustable components.

Moreover, it should be noted that a transverse movement of hood 10 absorbed by radial bearings 14 generates the same transverse movement of piston rods 71 and 71' of recoil brakes 7 and 7' relative to cradle tube 5 since the piston rods are supported on hood 10. If these transverse movements do not remain in an order of magnitude of the inherent elasticity of piston rods 71 and 71', recoil brakes 7 and 7' or, more precisely, their piston rods 71, 71' must be provided with an appropriate support. However, as soon as the transverse force becomes so large that cradle tube 5 also moves, there will be no transverse stress on piston rods 71 and 71'.

It is also conceivable to provide cradle tube 5 with centering members which are released by the recoiling gun barrel 4.

The invention now being fully described, it will be apparent to one of ordinary skill in the art that any changes and modifications can be made thereto without departing from the spirit or scope of the invention as set forth herein.

What is claimed is:

1. A tank turret comprising: an armored turret housing having a race ring for mounting said housing on a support for rotation and a separate solid front armor at a front side of said housing; a gun cradle tube having trunnions disposed and mounted within said turret housing for pivotal movement about said trunnions; a gun barrel mounted in said cradle tube to be pivotal with said cradle tube and displaceable in a longitudinal direction of said gun barrel; means for supporting said solid front armor for movement in the longitudinal horizontal direction of said gun barrel; a damping element disposed between said front armor and said turret housing; and means for connecting said solid front armor with said gun barrel for movement thereof in said longitudinal horizontal direction in order to increase the recoiling mass, said means for connecting including at least one recoil braking device connected between said gun barrel and said solid front armor.

2. A tank turret as defined in claim 1, wherein said recoil braking device is composed of two recoil brakes disposed respectively on opposite sides of said gun barrel, with each of said recoil brakes having a brake cylinder fastened to a breech ring of said gun barrel and a brake piston rod connected to said solid front armor at a front end thereof.

3. A tank turret as defined in claim 2, wherein: each of said brake piston rods is connected to said solid front armor via a hood to which each said piston rods is fastened, with said hood being disposed on said gun barrel in front of said solid front armor for pivotal movement with said gun barrel; and said hood is supported on said front armor by correspondingly shaped circular faces on said hood and on said front armor.

4. A tank turret as defined in claim 3, wherein said damping element is a rubber plate.

5. A tank turret as defined in claim 3, wherein said means for supporting said solid front armor includes a pivot beam mounted on said race ring of said turret housing and extending transverse to said longitudinal direction of said gun barrel, and a correspondingly shaped recess formed in a bottom surface of said solid front armor and into said pivot beam extends, said recess being elongated in said longitudinal direction and being positioned in said longitudinal direction to permit said solid front armor to slide toward the rear in approximately said horizontal direction with a pitching movement about the axis of said pivot beam.

6. A tank turret as defined in claim 5, further comprising an elastic radial support bearing inserted in said hood to permit said hood to perform a transverse movement relative to said cradle tube.

7. A tank turret as defined in claim 5, wherein said damping element is a rubber plate.

8. A tank turret as defined in claim 1, wherein said damping element is a rubber plate.

9. A tank turret as defined in claim 1, wherein said means for supporting said solid front armor includes a pivot beam mounted on said race ring of said turret housing and extending transverse to said longitudinal direction of said gun barrel, and a correspondingly shaped recess formed in a bottom surface of said solid front armor and into said pivot beam extends, said recess being elongated in said longitudinal direction and being positioned in said longitudinal direction to permit said solid front armor to slide toward the rear in approximately said horizontal direction with a pitching movement about the axis of said pivot beam.

* * * * *